US006918432B2

(12) United States Patent
Ozaki

(10) Patent No.: US 6,918,432 B2
(45) Date of Patent: Jul. 19, 2005

(54) HEAT EXCHANGER

(75) Inventor: Tatsuo Ozaki, Okazaki (JP)

(73) Assignee: DENSO Corporation, Kariya (JP)

( * ) Notice: Subject to any disclaimer, the term of this patent is extended or adjusted under 35 U.S.C. 154(b) by 0 days.

(21) Appl. No.: 10/162,351

(22) Filed: Jun. 4, 2002

(65) Prior Publication Data

US 2002/0189799 A1 Dec. 19, 2002

(30) Foreign Application Priority Data

Jun. 13, 2001 (JP) ..... 2001-178970

(51) Int. Cl.[7] ..... F28F 1/20
(52) U.S. Cl. ..... 165/152; 165/181; 165/906
(58) Field of Search ..... 165/151, 153, 165/140, 906, 152, 181

(56) References Cited

U.S. PATENT DOCUMENTS 4,328,861 A * 5/1982 Cheong et al. ..... 165/151
5,311,935 A * 5/1994 Yamamoto et al. ..... 165/152
5,312,230 A * 5/1994 Oda et al. ..... 416/234
5,558,156 A * 9/1996 Tsutsui ..... 165/152
5,730,214 A * 3/1998 Beamer et al. ..... 165/152
6,155,335 A * 12/2000 Acre et al. ..... 165/41
6,357,518 B1 * 3/2002 Sugimoto et al. ..... 165/140

FOREIGN PATENT DOCUMENTS

| | | | | |
|---|---|---|---|---|
| JP | 61-59195 | | 3/1986 | |
| JP | 362255791 | A * | 11/1987 | |
| JP | 0014092 | * | 1/1988 | ..... 165/152 |
| JP | 2-77477 | | 6/1990 | |
| JP | 6-147785 | | 5/1994 | |
| JP | 06221787 | A * | 8/1994 | ..... F28F/1/32 |
| JP | 9-280754 | | 10/1997 | |
| JP | 2000-220983 | | 8/2000 | |

* cited by examiner

*Primary Examiner*—Tho V Duong
(74) *Attorney, Agent, or Firm*—Harness, Dickey & Pierce, PLC

(57) ABSTRACT

In the fin 112 on the front grille side which is an upstream side of the air current, there is provided a reinforcing portion 112*c* formed when the fin 112 is made into a wave-shape. By this reinforcing portion 112*c*, it is possible to prevent the core portion 110 (fin 112) from being deformed by water at high pressure. Therefore, it is possible to reduce the thickness of the fin 112 while the deformation of the fin 112 is prevented even if washing is conducted with water at high pressure.

4 Claims, 6 Drawing Sheets

HEAT EXCHANGER

BACKGROUND OF THE INVENTION

1. Field of the Invention

The present invention relates to a heat exchanger. The present invention is effectively applied to a radiator, for vehicle use, which is mounted on a vehicle and arranged close to a front grille of the vehicle.

2. Description of the Related Art

Recently, the cooling capacity of a radiator has been enhanced by increasing the surface area of each fin while the weight and size of the radiator has been reduced by decreasing the wall thickness of the fin.

In this connection, when the fin thickness is reduced, it is possible to reduce the weight of a radiator and increase the surface area of the fin. However, the mechanical strength of the fin is lowered. Therefore, for example, when the radiator for vehicle use is washed with water at high pressure, the fin is deformed by the water pressure, and the heat exchanging capacity (cooling capacity) of the fin (especially, the fin in which a louver is formed) is lowered.

In this connection, as it is well known, the louvers are formed by cutting and raising a portion of the fin so that portions of the fin can be formed into a louvers for enhancing the heat transfer coefficient.

SUMMARY OF THE INVENTION

In view of the above points, it is an object of the present invention to reduce the thickness of a fin while deformation of the fin is prevented even when it is washed with water at high pressure.

In order to accomplish the above object, according to an aspect of the present invention, a heat exchanger comprises: a tube (111) in which fluid flows, the cross section of which is formed flat; and a fin (112) for facilitating heat exchange between air and a fluid, provided on a planar face (111*a*) on an outer surface of the tube (111), a portion of the fin being cut and raised so that the portion is formed into a louver, wherein dimension Wf of a portion of the fin (112) parallel to the direction of the major axis of the tube (111) is not more than outer diameter Wt of the tube (111) in the direction of the major axis, and a reinforcing portion (112*c*), the shape of which is different from that of the louver (112*b*), for enhancing rigidity of the fin (112) is provided in the fin (112) on the upstream side of an air current.

Due to the foregoing, for example, it is possible to prevent a portion of the fin (112) on the upstream side of the air current, on which water pressure at high pressure water directly acts, from being deformed. Therefore, even if washing is conducted by water at high pressure, the wall thickness of the fin (112) can be reduced while deformation of the fin (112) is prevented.

According to another aspect of the present invention, a heat exchanger mounted on a vehicle at a position close to a front grille, to cool cooling water by exchanging heat between cooling water and air, comprises: a tube (111) in which cooling water flows, the cross section of which is formed flat; and a fin (112) for facilitating heat exchange between air and fluid, provided on a planar face (111*a*) on an outer surface of the tube (111), a portion of the fin being cut and raised so that the portion is formed into a louver (112*d*, 122*d*), wherein dimension Wf of a portion of the fin (112) parallel to the direction of the major axis of the tube (111) is not more than outer diameter Wt of the tube (111) in the direction of the major axis, and a reinforcing portion (112*c*), the shape of which is different from that of the louver (112*d*), for enhancing rigidity of the fin (112) is provided in the fin on the front grille side.

Due to the foregoing, for example, it is possible to prevent a portion of the fin (112) on the front grille side of the air current, on which water pressure at high pressure water directly acts, from being deformed. Therefore, even if washing is conducted by water at high pressure, the wall thickness of the fin (112) can be reduced while deformation of the fin (112) is prevented.

In this connection, the reinforcing portion (112*c*) may be composed by plastically deforming a portion of the fin (112) into a wave shape.

According to still another aspect of the present invention, a heat exchanger mounted on a vehicle at a position close to a front grille, to cool cooling water by exchanging heat between cooling water and air, comprises: a tube (111) in which cooling water flows, the cross section of which is formed flat; and a fin (112) for facilitating heat exchange between air and fluid, provided on a planar face (111*a*) on an outer surface of the tube (111), a portion of the fin being cut and raised so that the portion is formed into a louver (112*d*, 122*d*), wherein size Wf of a portion of the fin (112) parallel to the direction of the major axis of the tube (111) is not more than outer diameter Wt of the tube (111) in the direction of the major axis, and length L1 of the louver (112*b*) located on an upstream side of the air current of the fin (112) is shorter than length Lo of the louver (112*b*) located at an approximately central portion in the air flowing direction of the fin (112).

Due to the foregoing, for example, it is possible to prevent a portion of the fin (112) on the upstream side of the air current, on which water pressure at high pressure water directly acts, that is, a portion of the fin on the front grille side, from being deformed. Therefore, even if washing is conducted by water at high pressure, the wall thickness of the fin (112) can be reduced while deformation of the fin (112) is prevented.

Note that the reference numerals in brackets are used for clarifying the relationship between components of the present invention and the concrete means shown in embodiments described later.

The present invention may be more fully understood from the description of preferred embodiments of the invention, as set forth below, together with the accompanying drawings.

DESCRIPTION OF THE PREFERRED EMBODIMENTS (First Embodiment)

Figure 1:
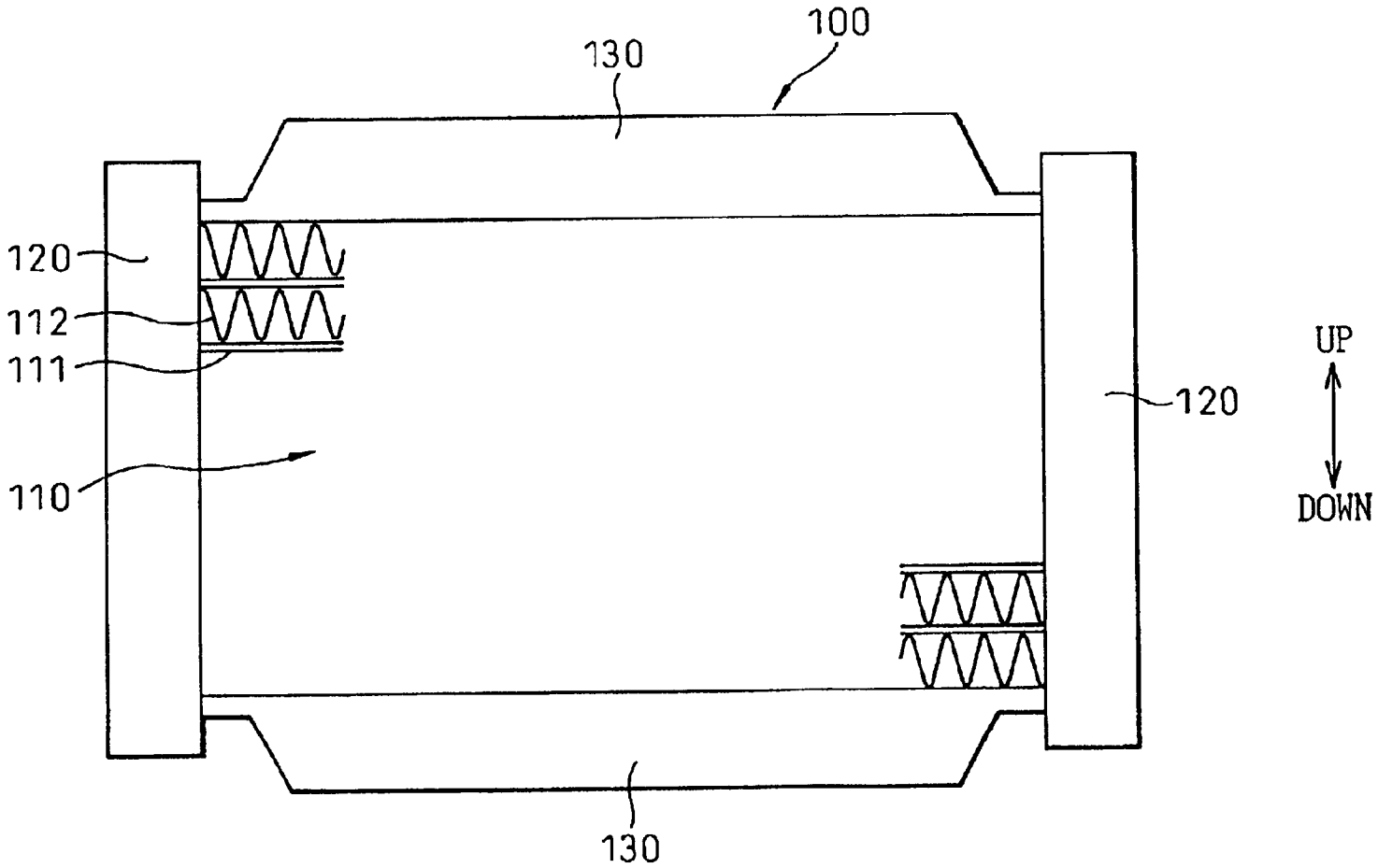
FIG. 1 is a front view of a heat exchanger (radiator) relating to an embodiment of the present invention.
Figure 2:
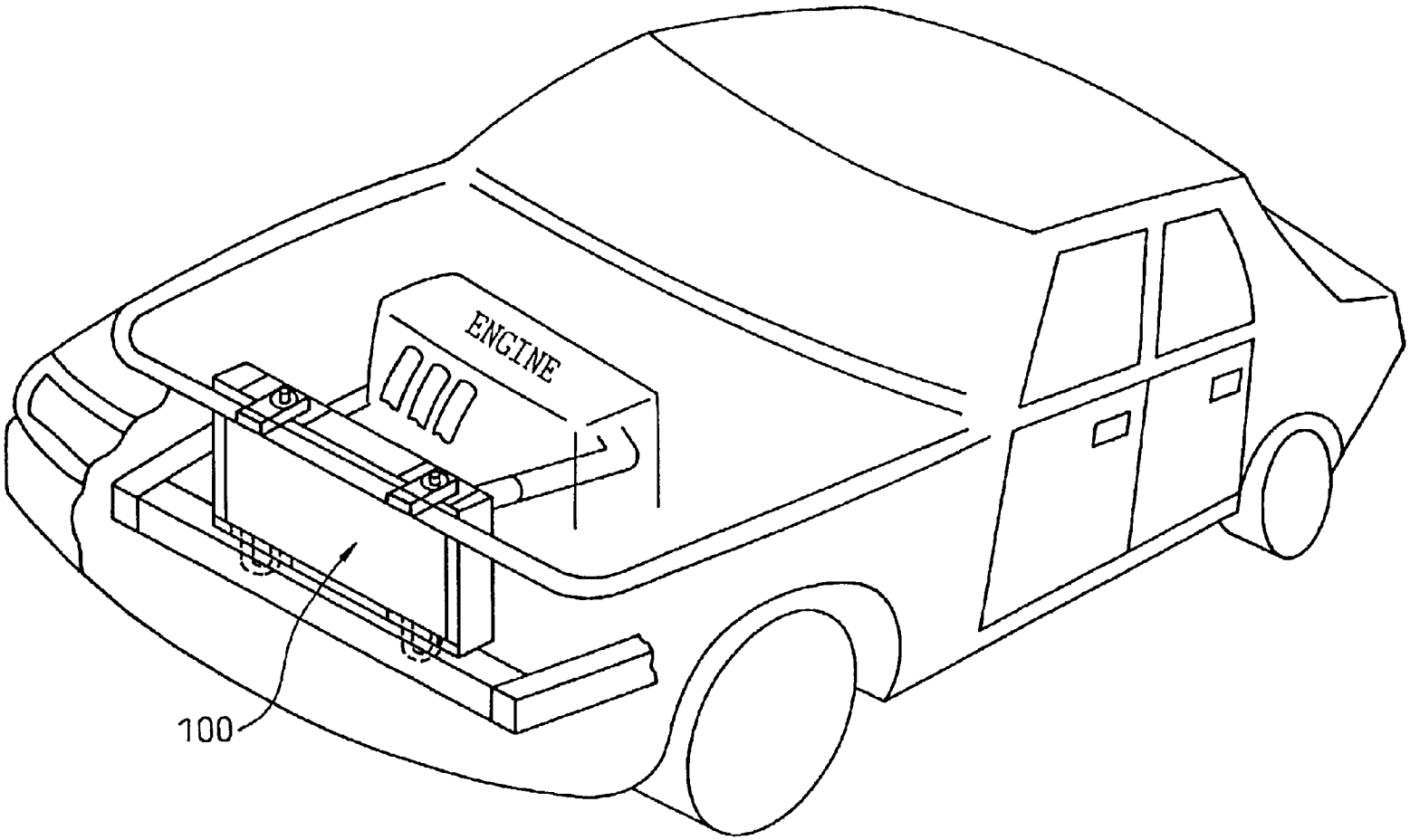
FIG. 2 is a schematic perspective illustration showing a state of mounting a heat exchanger (radiator) relating to the embodiment of the present invention on a vehicle.
Figure 3:
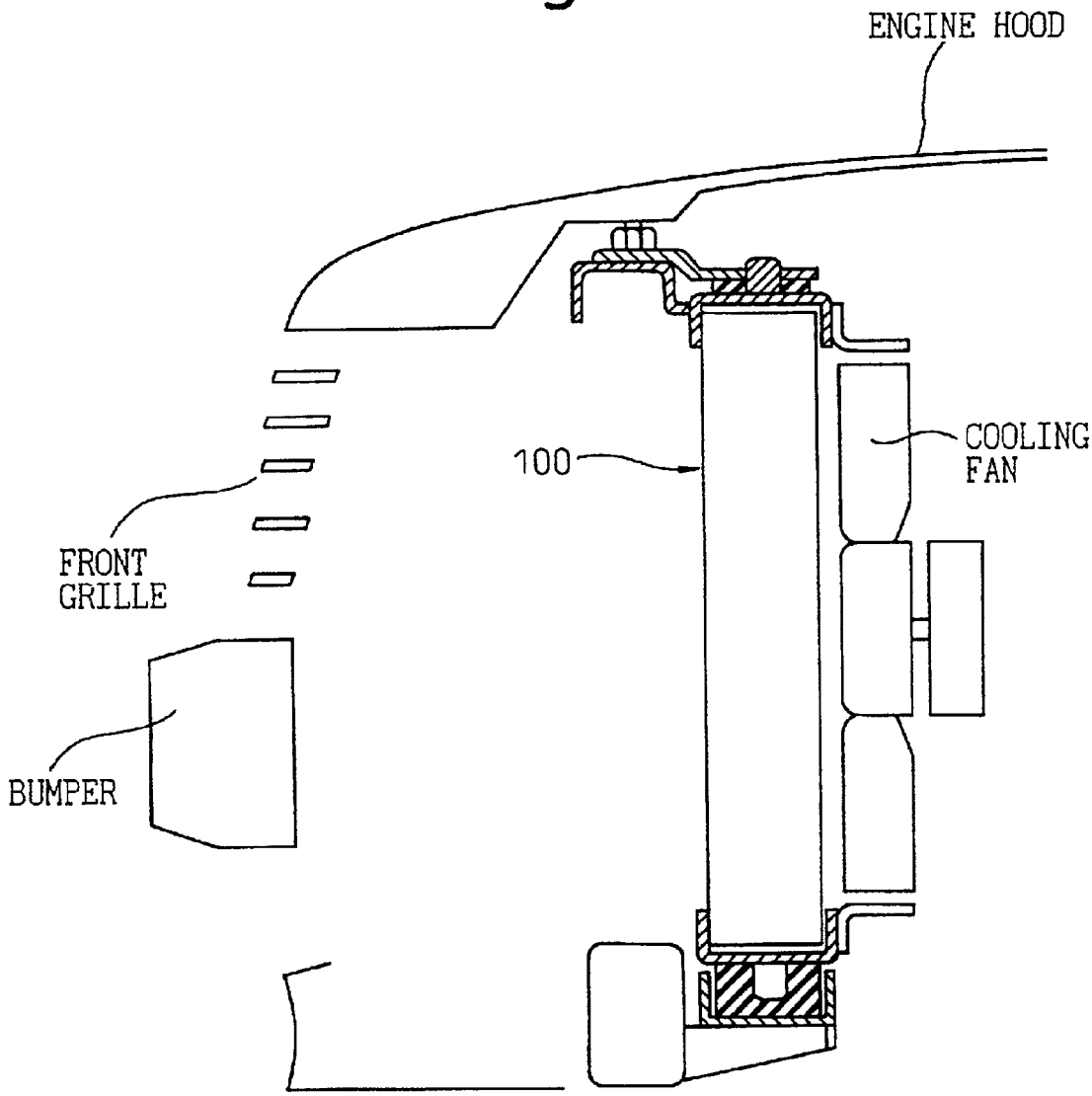
FIG. 3 is a schematic side view showing a state of mounting a heat exchanger (radiator) relating to the embodiment of the present invention on a vehicle.

In this embodiment, a heat exchanger of the present invention is applied to the radiator 100 to cool cooling water by exchanging heat between cooling water (fluid), which cools an internal combustion engine used for driving a vehicle, and air. FIG. 1 is a front view of the radiator 100, that is, FIG. 1 is a view of the radiator 100, wherein the view is taken from the upstream side of the air current. As shown in FIGS. 2 and 3, the radiator 100 is incorporated into a portion close to the front grille, from which cooling air is taken in, which is arranged in the front end portion of a vehicle (engine compartment).

As shown in FIG. 1, the radiator 100 includes: a core portion 110 composed of a plurality of tubes 111, in which cooling water is circulated, and fins 112 which are arranged between the tubes 111 and formed into a wave shape by means of roller forming; and header tanks 120 which are arranged on both sides of the tubes 111 in the longitudinal direction and communicated with the tubes 111.

In this connection, side plates 130 are arranged on the end portion of the core portion 110 different from the portion in which the header tanks 120 are arranged, and all parts composing the radiator 100 including the tubes 111, fins 112, header tanks 120 and side plates 130 are made of a relatively light metal (aluminum in this embodiment).

The tube 111 and the fin 112 are soldered to each other by solder material which is clad on the front and rear faces of the fin 112. The tube 111 and side plate 130 are soldered to the header tank 120 by solder material which is clad on the surface of the header tank 120.

Figure 4A:
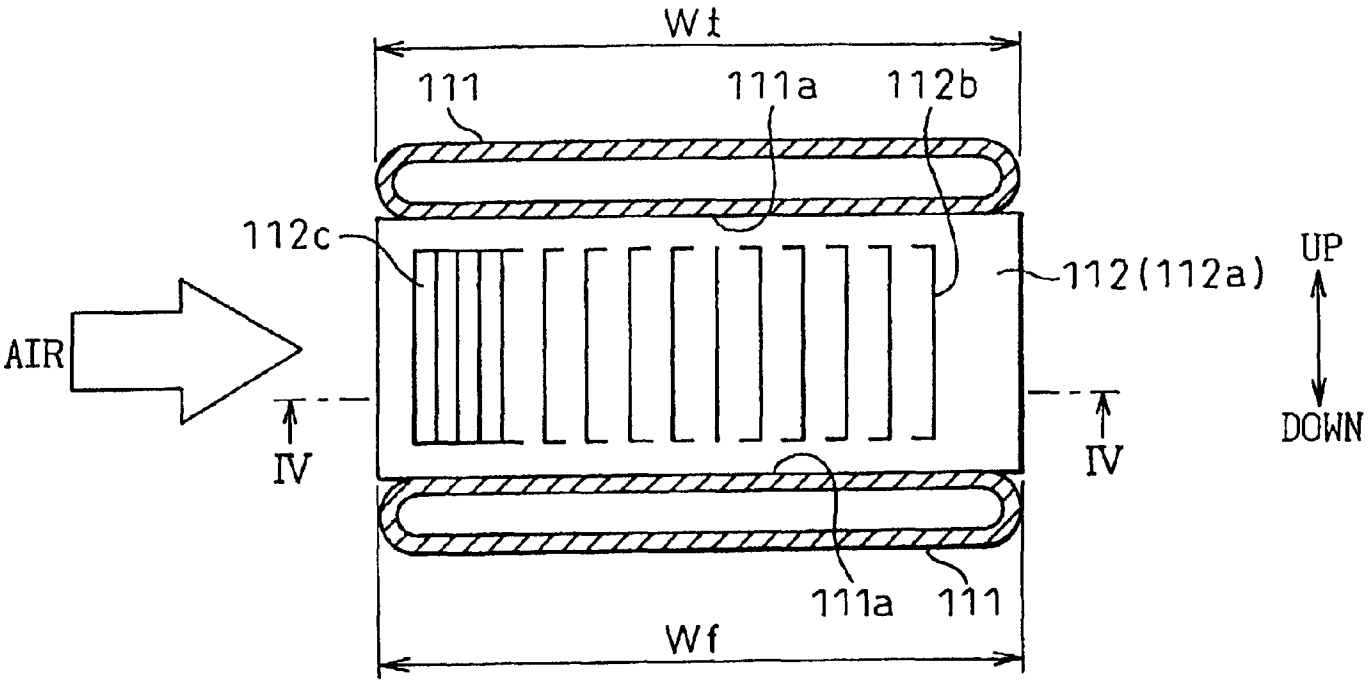
FIG. 4A is a sectional view of a core portion of a radiator relating to a first embodiment of the present invention.

In this case, as shown in FIG. 4A, the sectional shape of the tube 111 is formed flat (elliptic) so that the direction of the major axis on the section of the tube 111 can agree with the direction of an air current (the longitudinal direction of the vehicle). A bent portion of the fin 112 is soldered onto the planar face 111*a* of the tube 111 connecting the arc portions at both end portions in the major axis direction.

In the plane portion (the portion connecting one bent portion with the other bent portion) 112*a* of the fin 112, there are provided a plurality of louvers 112*b* for suppressing (for enhancing the heat transfer coefficient) the growth of a temperature boundary layer by disturbing a current of air flowing around the fin. These louvers 112*b* are formed when a portion of the plane portion 112*a* is cut and raised up so that the portion can be formed into a louver shape.

Dimension Wf (this dimension will be referred to as a fin width hereinafter) of a portion of the fin 112, which is parallel to the major axis of the tube 111, is not more than dimension Wt (this dimension will be referred to as a tube width hereinafter) of the outer diameter of the tube 111 in the major axis direction (Wf=Wt in this embodiment). On the upstream side (the front side of a vehicle) of an air current of the fin 112, there is provided a reinforcing portion 112*c* for enhancing the rigidity of the fin 112 by forming the shape of the reinforcing portion 112*c* to be different from the shape of the louver 112*b*.

Figure 4B:
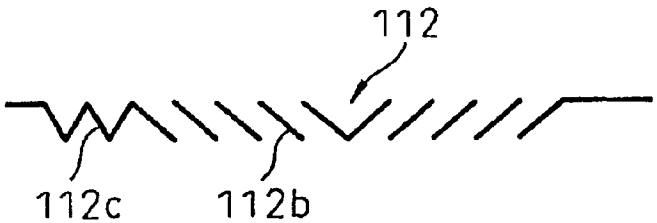
FIG. 4B is a sectional view taken along line IV—IV in FIG. 4A.

As shown in FIG. 4B, in this embodiment, the reinforcing portion 112*c* is composed when a portion of the fin 112 (the plane portion 112*a*) is plastically deformed into a wave-shape.

Next, the characteristic (the mode of operation) of this embodiment will be explained below.

When washing is conducted with water of high pressure, the water of high pressure flows into the engine compartment from the front grille, which is an inlet of cooling air, and directly collides with the radiator 100 (the core portion 110). However, in this embodiment, the reinforcing portion 112*c* is provided on the front grille side of the fin 112 which is an upstream side of the air current. Therefore, the deformation of the core portion 110 (the fin 112) caused by water at high pressure can be prevented in the process of washing.

Consequently, according to the present embodiment, even if washing is conducted with water at high pressure, while the deformation of the fin 112 is prevented, it is possible to reduce the wall thickness of the fin 112. In this embodiment, it is possible to reduce the wall thickness to be not more than 60 $\mu$m. Therefore, while the weight of the radiator 100 is reduced, the surface area of the fin 112 can be increased. That is, while an increase in the size of the radiator 100 is being suppressed, it is possible to enhance the cooling capacity of the radiator 100.

(Second Embodiment)

Figure 5A:
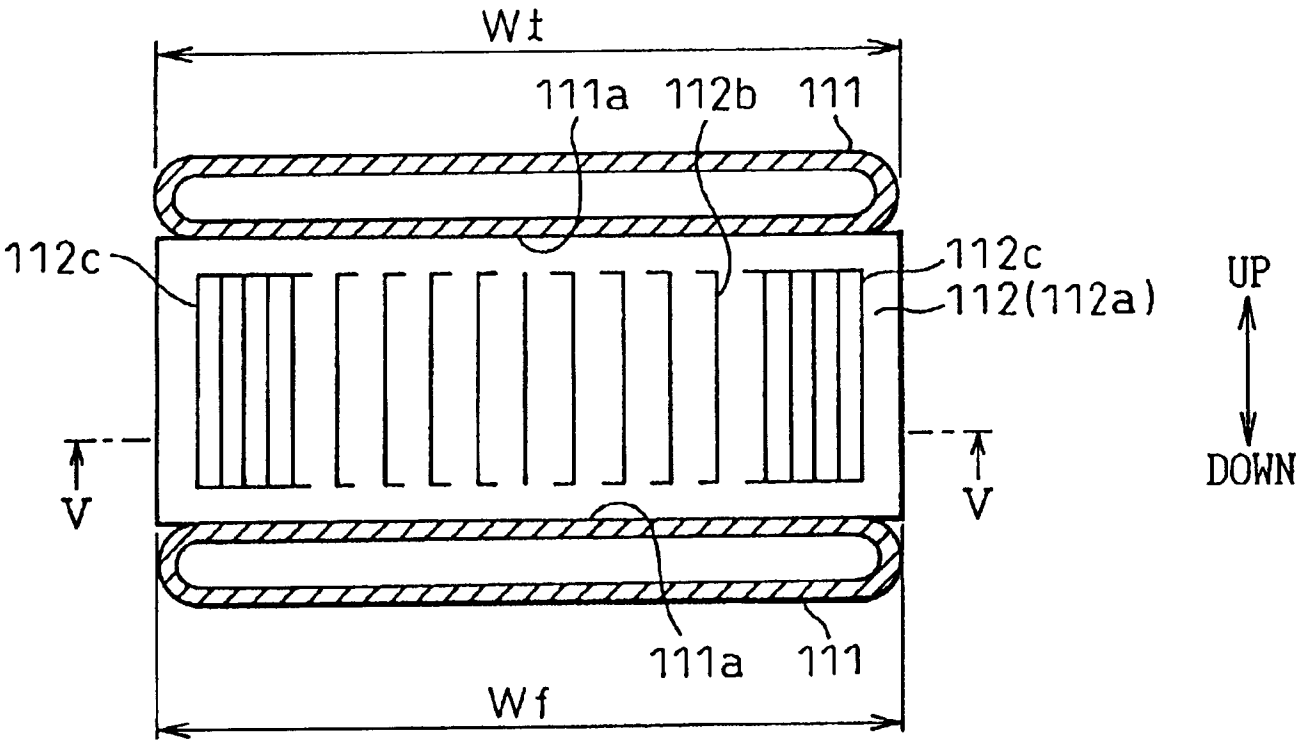
FIG. 5A is a sectional view of a core portion of a radiator relating to a second embodiment of the present invention.
Figure 5B:
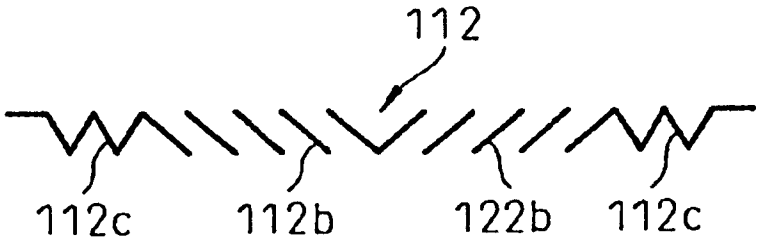
FIG. 5B is a sectional view taken along line V—V in FIG. 5A.

In the embodiment described above, the reinforcing portion 112*c* is provided only on the front grille side which is the upstream side of an air current. However, in this embodiment, as shown in FIGS. 5A and 5B, the reinforcing portion 112*c* is provided on both end sides (the end portion on the upstream side and the end portion on the downstream side) of the fin 112 in the air flowing direction.

(Third Embodiment)

Figure 6A:
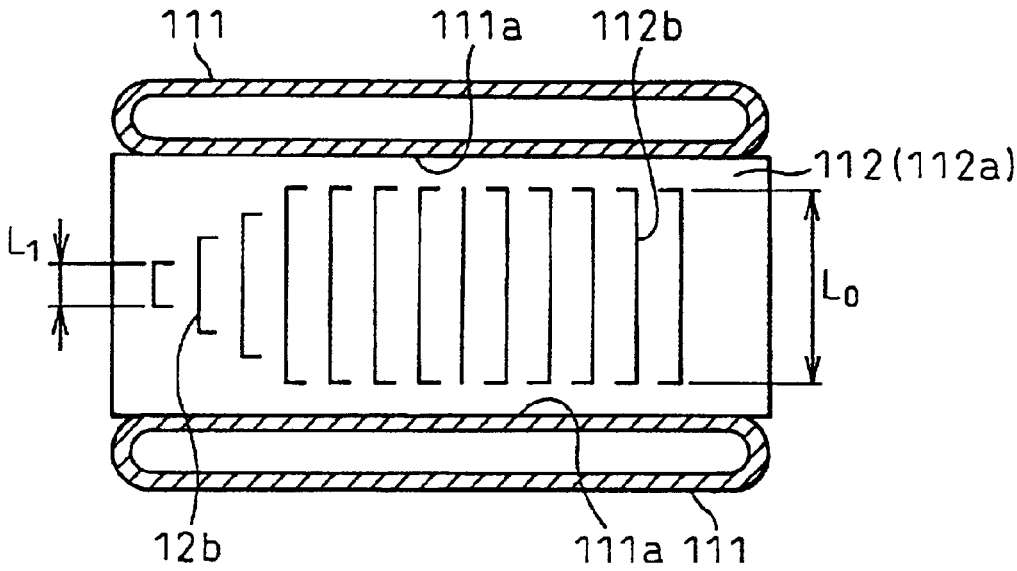
FIG. 6A is a sectional view of a core portion of a radiator relating to a third embodiment of the present invention.
Figure 6B:
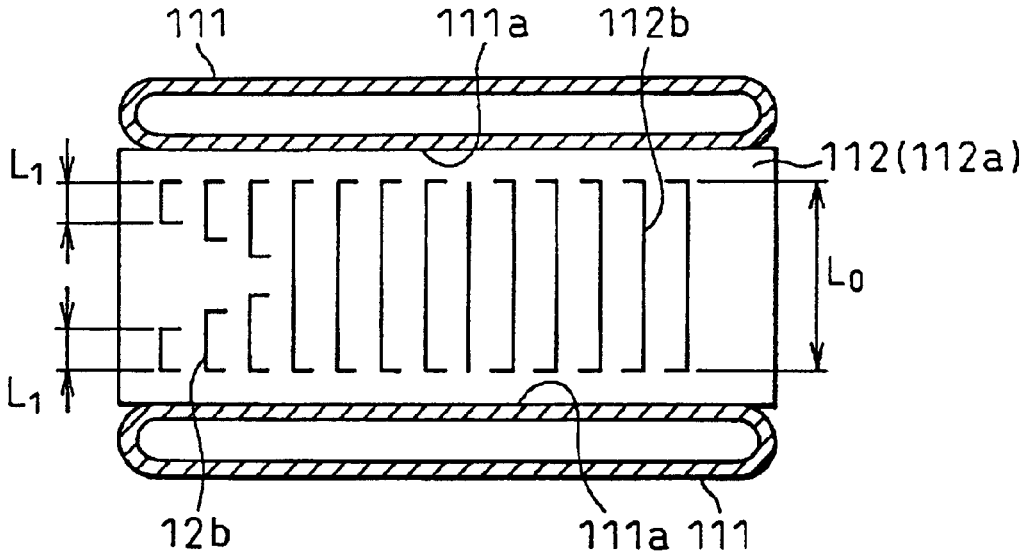
FIG. 6B is a sectional view of a core portion of a radiator relating to a third embodiment of the present invention.

In the above embodiment, the reinforcing portion 112*c* is composed when the fin 112 (the plane portion 112*a*) is plastically deformed into a wave-shape. As shown in FIGS. 6A and 6B, in this embodiment, the reinforcing portion 112*c* is composed in such a manner that length L1 of the louver 112*b* located on the upstream side of the air current of the fin 112 is made to be shorter than length Lo of the louver 112*b* located at a substantially central portion in the direction of the air current of the fin 112. In this connection, the length (the cutting length) of the louver 112*b* is defined as the cutting length of the louver 112*b* perpendicular to the direction of the air current.

Due to the above structure, the mechanical strength of the fin 112 on the upstream side of the air current becomes higher than that of the substantially central portion of the fin 112. Therefore, the portion of the fin 112, which is directly exposed to water at high pressure, can be prevented from being deformed by water pressure.

Consequently, according to the present embodiment, even if washing is conducted with water at high pressure, while the deformation of the fin 112 is prevented, it is possible to reduce the wall thickness of the fin 112. Therefore, while the weight of the radiator 100 is reduced, the surface area of the fin 112 can be increased. That is, while an increase in the size of the radiator 100 is suppressed, it is possible to enhance the cooling capacity of the radiator 100.

In this connection, in this embodiment, the length of the louver 112*b* on only the upstream side of the air current is made to be shorter than that of the central portion. The length of the louver 112*b* on both end sides (the upstream side end portion and the downstream side end portion) in the direction of the air current of the fin 112 may be made to be shorter than the length of the louver 112*b* at the central portion.

In this connection, FIG. 6A shows a case in which the length L1 of the louver 112*b* is shortened on both end sides of the louver 112*b* in the cutting direction, and FIG. 6B shows a case in which the length L1 of the louver is shortened at a substantially central portion of the louver 112*b* in the cutting direction.

(Another Embodiment)

In the first and the second embodiment described above, the reinforcing portion 112*c* is composed when a portion of the fin 112 is formed into a wave-shape. In the third embodiment, the reinforcing portion 112*c* is composed when length L1 of the louver is shortened. However, it should be noted that the present invention is not limited to the above specific embodiments. The reinforcing portion 112*c* may be composed by other means.

In the embodiments described above, the present invention is applied to a radiator for vehicle use. However, it should be noted that the present invention is not limited to the above specific embodiments. It is possible to apply the present invention to other heat exchangers.

In the embodiments described above, the present invention is applied to a radiator for vehicle use mounted on the front end of a vehicle. However, it should be noted that the present invention is not limited to the above specific embodiments. It is possible to apply the present invention to a heat exchanger mounted at the rear of a vehicle.

What is claimed is:

1. A heat exchanger comprising:

a tube in which fluid flows, the cross section of which is formed flat to define a major axis and a minor axis; and a fin for facilitating heat exchange between air and fluid, provided on a planar face of an outer surface of the tube, a portion of the fin being cut and raised so that the portion is formed into a louver, wherein a dimension of the fin parallel to the direction of the major axis of the tube is not more than an outer diameter of the tube in the direction of the major axis, a reinforcing portion, the shape of which is different from that of the louver, for enhancing the rigidity of the fin is provided in the fin on the upstream end and the downstream end of the fin in a direction of an air current, the louver being disposed between the reinforcing portion on the upstream end of the fin and the reinforcing portion on the downstream end of the fin;

the length of the reinforcement portion perpendicular to the direction of the air current is generally equal to the cutting length of the louver;

the reinforcing portion is composed by plastically deforming a portion of the fin into a wave-shape; and the reinforcing portion is formed over a majority of the width of the fin perpendicular to the direction of the air current.

2. A heat exchanger according to claim 1, wherein the wall thickness of the fin is not more than 60 $\mu$m.

3. A heat exchanger mounted on a vehicle at a position close to a front grille, to cool cooling water by exchanging heat between cooling water and air, comprising:

a tube in which cooling water flows, the cross section of which is formed flat to define a major axis and a minor axis; and a fin for facilitating heat exchange between air and fluid, provided on a planar face on an outer surface of the tube, a portion of the fin being cut and raised so that the portion is formed into a louver, wherein a size of the fin parallel to the direction of the major axis of the tube is not more than an outer diameter of the tube in the direction of the major axis, a reinforcing portion, the shape of which is different from that of the louver, for enhancing the rigidity of the fin is provided in the ends of the fin on the front grille side and on the side opposite to the front grille side, the louver being disposed between the reinforcing portion on the end of the fin on the front grille side and the reinforcing portion on the end of the fin on the side opposite to the front grille side;

the length of the reinforcement portion perpendicular to the direction of the air current is generally equal to the cutting length of the louver;

the reinforcing portion is composed by plastically deforming a portion of the fin into a wave-shape; and the reinforcing portion is formed over a majority of the width of the fin perpendicular to the direction of the air current.

4. A heat exchanger according to claim 3, wherein the wall thickness of the fin is not more than 60 $\mu$m.

* * * * *